US005263722A

United States Patent [19]

Rosellen

[11] Patent Number: 5,263,722

[45] Date of Patent: Nov. 23, 1993

[54] AUTOMATICALLY RESETTABLE TARGET

[76] Inventor: Walter E. Rosellen, R.D. 1, Box 1490, Honesdale, Pa. 18431

[21] Appl. No.: 11,705

[22] Filed: Feb. 1, 1993

[51] Int. Cl.[5] ..... F41J 7/04

[52] U.S. Cl. ..... 273/391

[58] Field of Search ..... 273/391, 392

[56] References Cited

U.S. PATENT DOCUMENTS

| | | | |
|---|---|---|---|
| 996,712 | 7/1911 | Harper | 273/392 |
| 1,098,255 | 5/1914 | Harper | 273/392 |
| 1,348,540 | 8/1920 | Briggs | 273/388 |
| 3,306,614 | 2/1967 | Groff | 273/41 |
| 3,366,385 | 1/1968 | Burke | 273/391 X |
| 3,411,784 | 11/1968 | Lawrence | 273/392 X |
| 4,588,194 | 5/1986 | Steidle et al. | 273/392 X |
| 4,949,980 | 8/1990 | Hoy | 273/391 |

*Primary Examiner*—William H. Grieb
*Attorney, Agent, or Firm*—Bernd Rosellen

[57] ABSTRACT

A multiple target apparatus with a plurality of individual targets or bullseyes that are adapted to be thrown out of their normal positions when struck by a bullet or other projectile with the means for automatically resetting the individual targets to their normal positions, also by the impact of a bullet or other projectile which allows for continuous target shooting without the necessity of manually resetting the target apparatus.

12 Claims, 6 Drawing Sheets

AUTOMATICALLY RESETTABLE TARGET

BACKGROUND OF THE INVENTION

1. Field of the Invention

This invention generally relates to a multiple target apparatus and, more particularly, to a target apparatus with a plurality of individual, movable targets that are meant to be thrown out of their normal, upright position from the impact of a bullet or other projectile, said individual, movable targets also being returned to their normal position from the impact of a bullet or other projectile and automatically reset for continued shooting.

2. Description of Related Art

The use of rifles, pistols, shotguns, firearms, and the like to shoot bullets or other projectiles at targets designed for that purpose is a common sport, hobby, and pastime for many people. Characteristics of targets used in such activity generally include clearly visible and easily identifiable areas of desired impact, commonly referred to as bullseyes, a means for determining the point of impact of the bullet or projectile, and the ability to change or reset the target.

A significant convenience to target shooters is the ability to shoot continuously at the bullseyes without having to manually change or reset the target.

Another convenience is the ability to clearly and easily determine when a bullseye has been struck.

An added convenience to target shooters is the ability to transport and position the target with ease.

Automatically resettable targets have been developed in various configurations, but quite unlike the invention described herein. For example, see U.S. Pat. Nos. 996,712; 1,098,255; 1,348,540; 3,227,442; 3,306,614; 3,366,385; and 3,411,784.

SUMMARY OF THE INVENTION

1. Objects of the Invention

The general object of this invention is to provide a multiple target apparatus comprising a plurality of individual, movable targets that are thrown out of their normal, upright position from the impact of a bullet or other projectile, with the means for automatically resetting the individual targets to their normal position, also from the impact of a bullet or other projectile.

Another object of this invention is to provide a plurality of individual targets that are individually, pivotally mounted and thrown backwards and down from the impact of a bullet or other projectile, said individual targets being kept from view until returned to their normal position.

A further object of this invention is to provide a means for continuously shooting at the individual targets without the necessity of manually resetting the individual targets to their normal, upright position after they have been struck down.

Another object of this invention is to provide a mechanical means for automatically resetting the individual targets to their normal, upright position simultaneously.

A still further object of this invention is to provide a mechanism that mechanically and automatically causes the individual targets to be returned to their normal, upright position, said mechanism being activated by the impact of a bullet or other projectile.

Still another object of this invention is to provide a compact, transportable target apparatus that can be positioned and removed quickly and easily.

Yet another object of this invention is to provide legs in a readily attachable/detachable manner to support the target apparatus.

A still further object of this invention is to provide a protective shield that absorbs, deflects, or otherwise prevents a bullet or other projectile from seriously damaging the target apparatus and its components.

2. Features of the Invention

In keeping with these objects, and others which will become apparent hereinafter, one feature of this invention resides, briefly stated, in a target apparatus with a plurality of individual targets which are thrown out of their normal position from the impact of a bullet or other projectile, said individual targets being automatically returned to their normal, upright position by a unique reset mechanism that is also activated by the impact of a bullet or other projectile. The target apparatus comprises a means for mechanically resetting the plurality of individual targets simultaneously after they have been thrown out of their normal positions.

Another feature of this invention is a plurality of spaced, individual targets, each comprised of a small disk or bullseye attached to one end of a peculiarly shaped rod, said rod being connected perpendicularly at the other end to a sleeve which is pivotally mounted on a horizontal shaft that allows the individual targets to be pivotally moved back and forth.

A further feature of this invention is a stop rod on which each individual target rests when thrown out of its normal position.

A further feature of this invention is a unique reset mechanism that is activated by the impact of a bullet or other projectile and causes the individual targets to be returned to their normal position after all the individual targets have been consecutively struck down.

Still another feature of this invention is a reset bar that causes the individual targets to be returned to their normal, upright position simultaneously with the aid of springs and levers.

A still further feature of this invention is a catch plate that holds in place the aforementioned reset bar after it has been moved out of its normal position.

Yet another feature of this invention is the springs and levers that provide the force to move said reset bar against the individual targets, causing said individual targets to be moved into their normal position.

Another feature of this invention is a square or similar shaped reset plate that is attached to a lever which activates the aforementioned reset mechanism. When said square reset plate is struck by a bullet or other projectile, it activates the reset mechanism and causes the individual targets to be returned to their normal positions.

In operating the multiple target apparatus, the small disk or bullseye of each individual target is consecutively struck by a bullet or other projectile causing the individual targets to swing backwards and down upon a stop rod on which the individual targets remain at rest and out of view. After all the individual targets have thusly been thrown out of their normal positions, the impact of a bullet or other projectile upon the aforementioned square reset plate causes all the individual targets to be pushed up and forward into view to their normal, upright positions simultaneously, thus resetting the target apparatus for further target shooting.

A still further feature of this invention is readily attachable/detachable legs made of rigid tubing that slip over smaller diameter protrusions on the target frame, said legs serving to support the target apparatus.

Yet another feature of this invention is a shield for the purpose of protecting the components of the target apparatus by absorbing, reducing, or deflecting the impact of a bullet or other projectile.

A further feature of this invention is a rectangular frame to which the individual components of the target apparatus are welded or otherwise connected and held uniformly and sturdily in place to perform in a manner according to the objects and features described herein.

The novel features which are considered as characteristic of the invention are set forth in particular in the appended claims. The invention itself, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
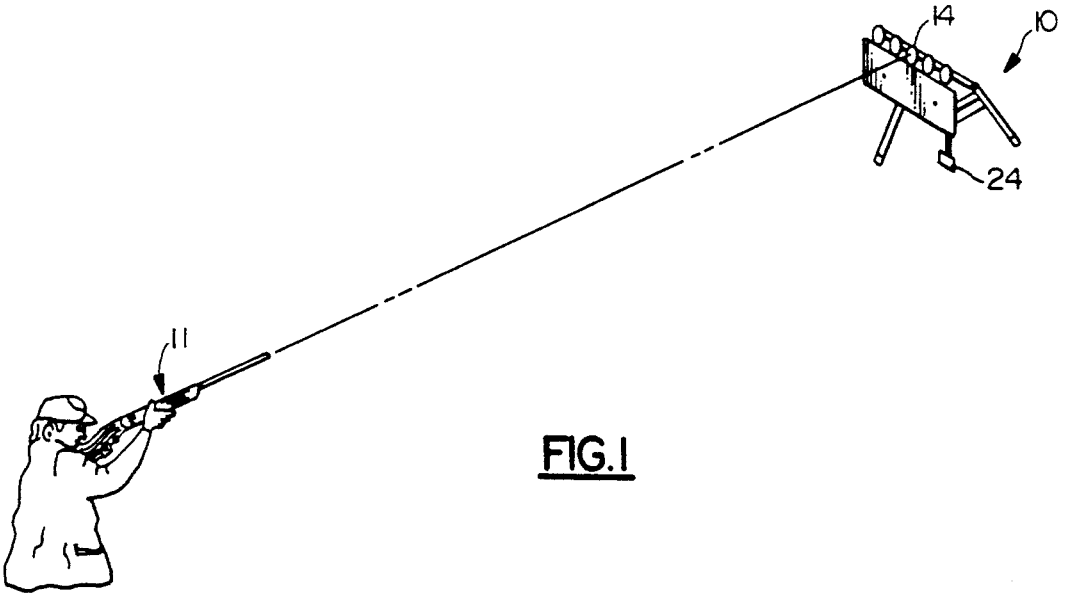
FIG. 1 is a general illustration depicting a typical use of the target apparatus.

Referring now to the drawings, and particularly to FIG. 1 thereof, reference numeral 10 which generally identifies the multiple target apparatus and illustrates a typical use of the invention. A bullet or other projectile is discharged from a rifle 11 or other shooting device and strikes one of the individual targets 14, preferably made from metal or similar material, causing said individual target 14 to be thrown back and down out of view. After all the individual targets 14 are struck down in this manner, striking reset plate 24, also made from metal or other suitable material, with a bullet or other projectile causes the individual targets 14 to be pushed up into their normal, upright position simultaneously, thus resetting the target apparatus 10 for further shooting.

Figure 2:
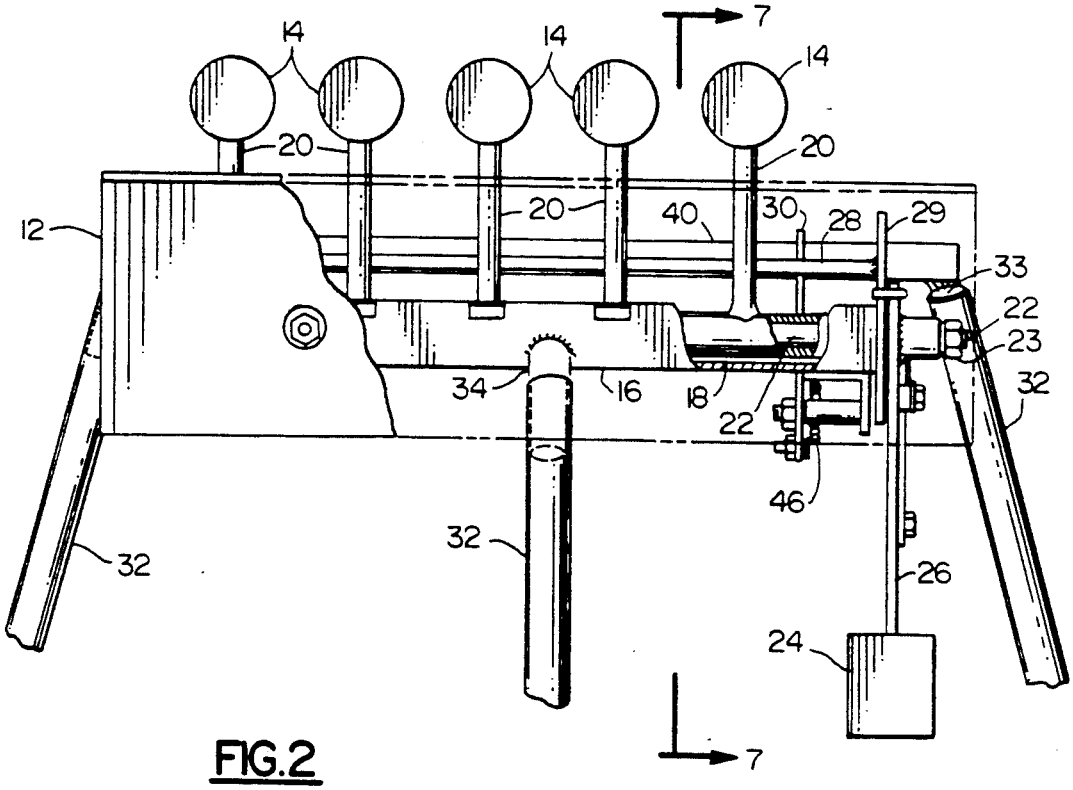
FIG. 2 is a frontal view of the target apparatus according to this invention, showing all the individual components in their normal position.

Turning now to FIG. 2, the target apparatus is illustrated from a frontal view with a cut-away of protective shield 12, preferably in the form of a wooden board or metal plate, revealing the individual targets 14 in their normal positions resting against front frame member 16. Individual targets 14 are welded or otherwise connected to the top end of target stems 20 which are perpendicularly connected at the lower end to sleeves 18 as revealed by partial cut-away view of front frame member 16, said sleeves 18 being pivotally mounted on pivot rod 22 which is partially revealed by a cut-away view of sleeve 18. Pivot rod 22 with opposite threaded ends is horizontally mounted to front frame member 16 and held in place by threaded fasteners 23 at opposite ends.

When any one of the individual targets 14 is struck by a bullet or other projectile, it pivots and falls backward against reset bar 28 and rests upon stop rod 40, said reset bar 28 being moved backward and in contact with catch plate 30 which frictionally holds reset bar 28 in place.

When the remaining individual targets 14 are consecutively struck down and back, resting upon stop rod 40, the impact of a bullet or other projectile upon reset plate 24 causes catch plate 30 to release reset bar 28, which, in turn, moves up and forward and comes in contact with target stems 20 and pushes individual targets 14 up into their normal, upright positions simultaneously.

The target apparatus 10 is mounted on legs 32 which are attached over protrusions 33, 34, said protrusions 33 being welded or otherwise connected to stop rod 40 one at each end and protrusion 34 being attached to front frame member 16. Legs 32 are attached in a frictionally retaining manner over protrusions 33, 34.

Figure 3:
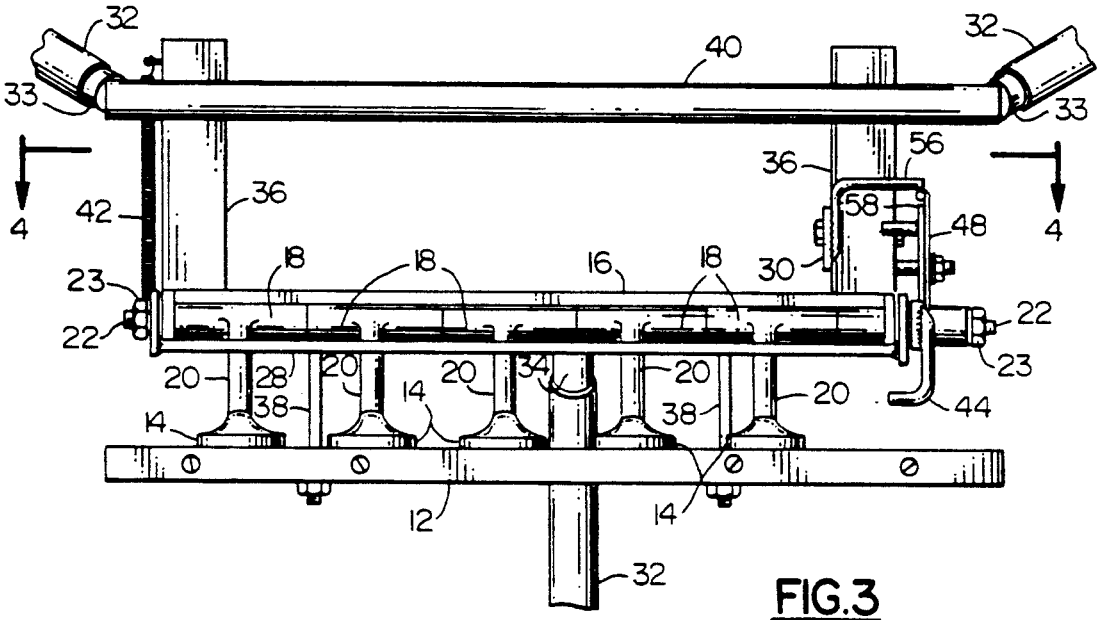
FIG. 3 is a top view of the invention with the front of the target apparatus facing south.

Turning now to FIG. 3, the target apparatus 10 is illustrated from a top down view and includes protective shield 12 connected to front frame member 16 by threaded fasteners 38.

Stop rod 40, which supports individual targets 14 when they have been thrown out of their normal positions, is welded or otherwise connected to frame 36.

A horizontally disposed pivot rod 22 has opposite threaded ends connected to front frame member 16 by threaded fasteners 23 with sleeves 18 individually and pivotally mounted thereon, said sleeves 18 having target stems 20 perpendicularly mounted thereon.

Figure 4:
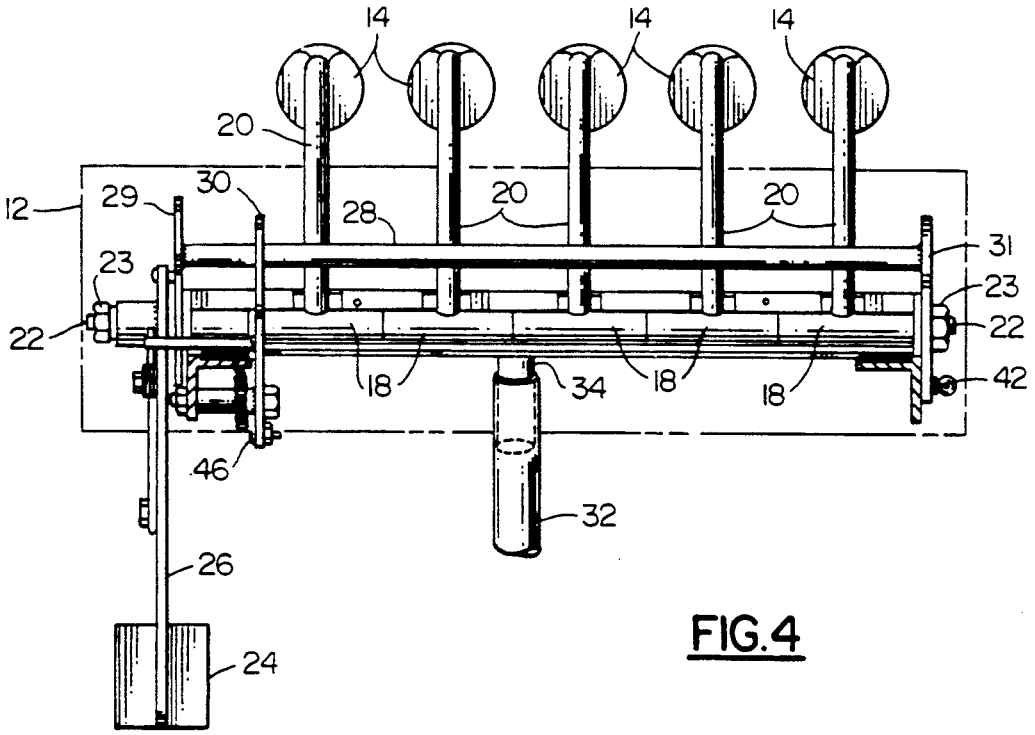
FIG. 4 is a sectional view taken on line 4—4 of FIG. 3.

FIG. 4 is a sectional view taken on line 4—4 of FIG. 3. A plurality of the aforementioned individual targets 14 are shown from behind in their normal upright position with reset bar 28 resting against target stems 20. Reset bar 28 is welded or otherwise connected at opposite ends to levers 29, 31, said levers 29, 31 being pivotally mounted on pivot rod 22 and shown, along with reset bar 28, in their normal position. When any one of the individual targets 14 is thrown back out of its normal position, reset bar 28 and levers 29, 31 are moved back out of their positions from the force of target stem 20 falling backwards and are held in place by catch plate 30. The remaining individual targets 14 are then consecutively struck down by a bullet or other projectile and fall freely backwards.

The impact of a bullet or other projectile upon reset plate 24 causes catch plate 30 to pivot slightly backwards and release reset bar 28, said catch plate 30 being returned to its normal position by the contracting force of spring 46. Upon its release from catch plate 30, reset bar 28 is forced up and forward against target stems 20 by the contracting force of spring 42 causing individual targets 14 to be returned to their normal upright positions.

Figure 5:
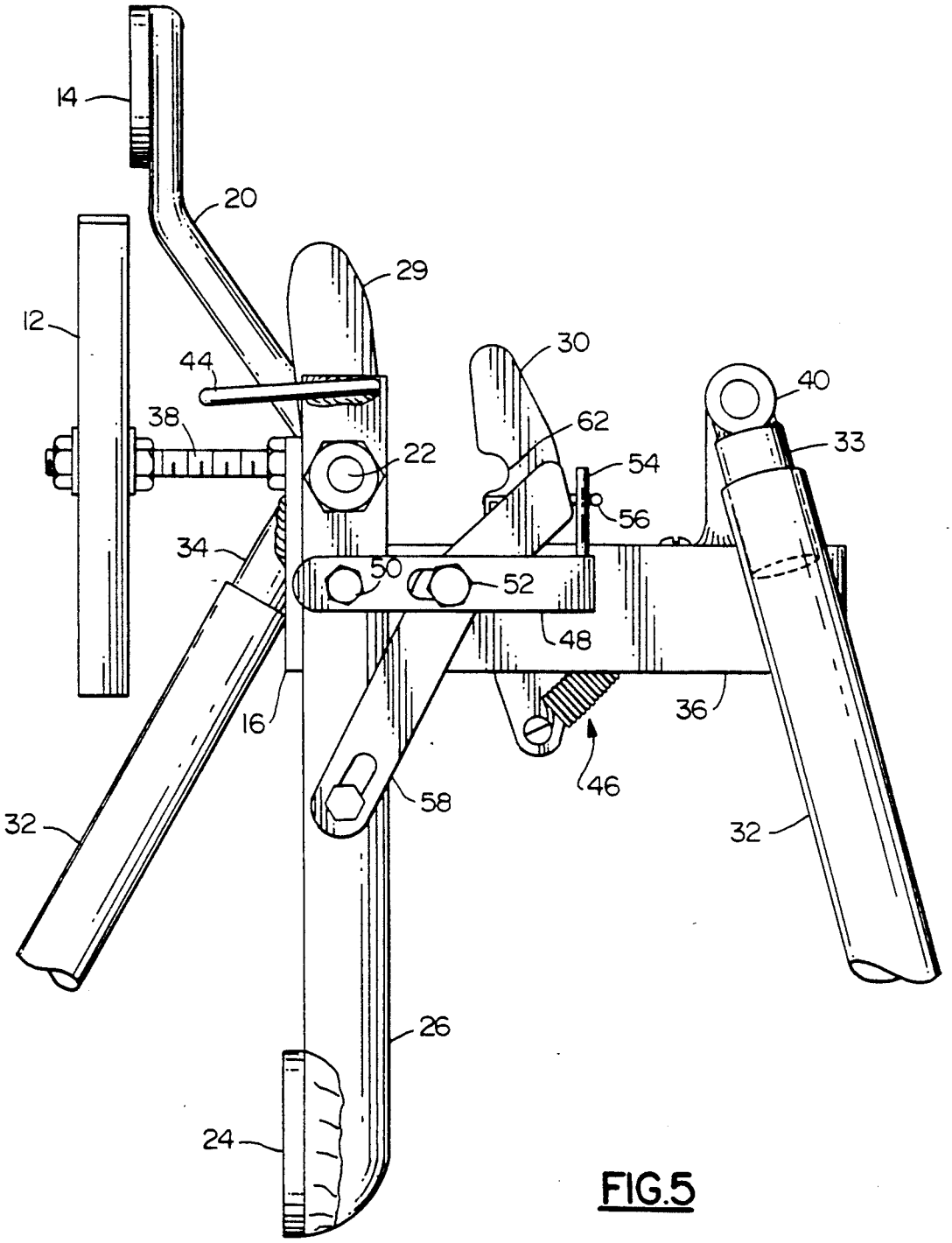
FIG. 5 is a side view of the target apparatus looking from right to left.

Moving now to FIG. 5, the target apparatus 10 is viewed from the right side with all its components in their normal position.

Target stem 20 is shaped so as to position individual targets 14 slightly above and behind protective shield 12. Reset plate 24 is shown attached to reset lever 26 by weldment or other means, said reset lever 26 being pivotally mounted on pivot rod 22.

The impact of a bullet or other projectile upon reset plate 24 causes reset lever 26 to pivotally move backwards. This action causes bar 48, which is loosely attached to reset lever 26 with bolt 50 and slides horizontally on bolt 52, to force engagement rod 54, which is perpendicularly mounted to bar 48, against catch rod 56, said catch rod 56 being attached to catch plate 30, and causing said catch plate 30 to pivot slightly backwards and extending spring 46.

When the action from the impact of a projectile upon reset plate 24 as described above has been completed, the constricting force of spring 46 causes catch plate 30 to move to its normal position. As catch plate 30 moves to its normal position, catch rod 56 pushes against engagement rod 54 which moves bar 48 forward, causing reset lever 26 to be returned to its normal position. Bar 58 is loosely mounted to reset lever 26 and pivotally mounted upon bolt 52, said bar 58 acting to hold reset lever 26 in its normal position.

FIG. 5 also illustrates the positioning of legs 32 on protrusions 33, 34. Protrusions 33 are perpendicularly mounted by weldment or other means at opposite ends of stop rod 40. The outside diameter of protrusions 33, 34 is slightly smaller than the inside diameter of legs 32, allowing legs 32 to be frictionally held on protrusions 33, 34. Legs 32 are angled outward to provide stability.

Figure 6:
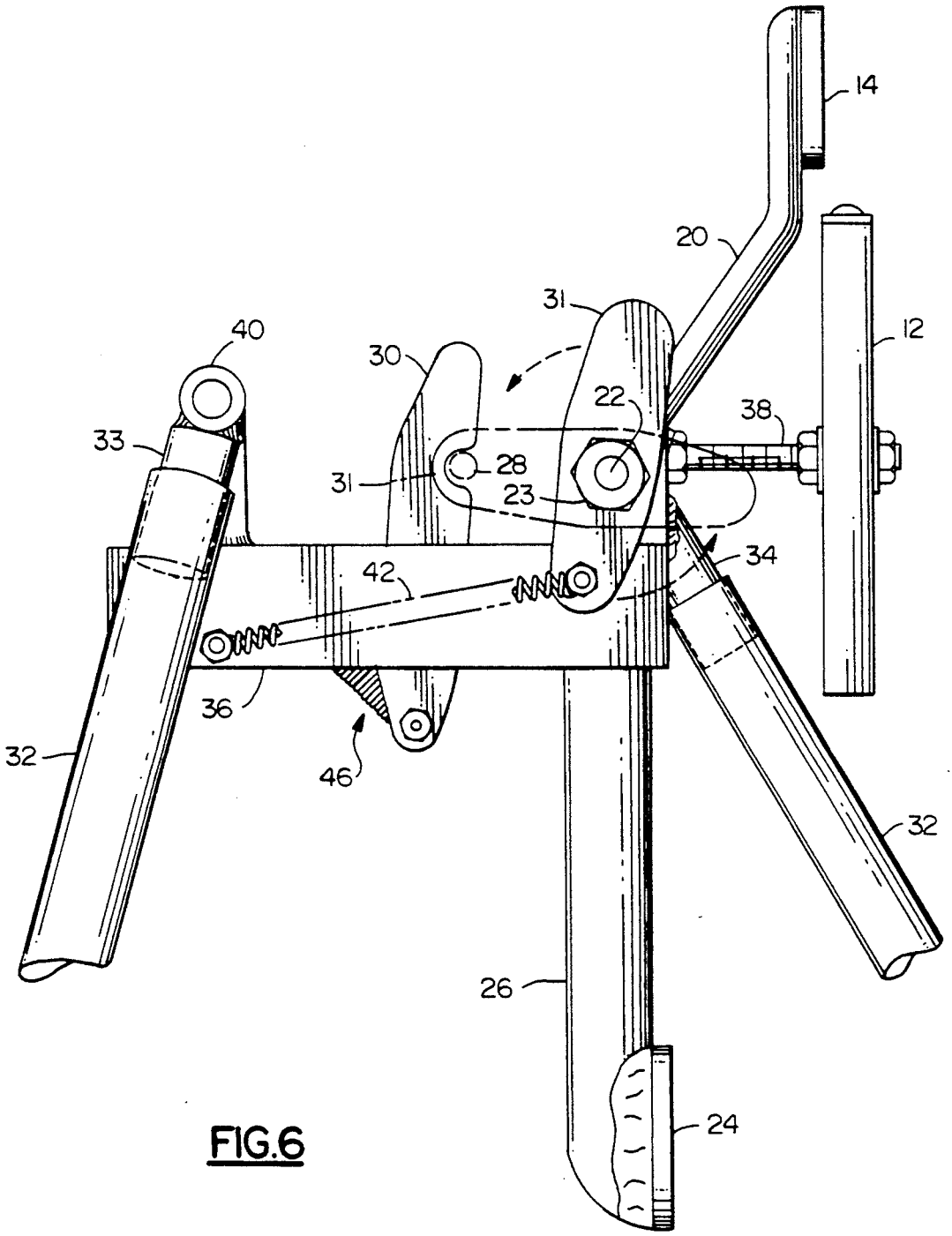
FIG. 6 is a side view of the target apparatus looking from left to right.

Turning now to FIG. 6, the target apparatus 10 is viewed from the left side with all its components in their normal position. Attention is drawn to spring 42 which is extended when lever 31 pivots upon pivot rod 22 in the direction of the dotted arrows resulting in a horizontal positioning of said lever 31 as depicted by broken lines. The pivoting of lever 31 is caused by individual target 14 being struck by a bullet or other projectile and causing target stem 20 to fall backwards against reset bar 28, which is attached to lever 31, causing target stem 20 to move said reset bar 28 in contact with catch plate 30. Reset bar 28 is depicted by broken lines being held in place by catch plate 30.

Lever 31 stays in its horizontal position as illustrated by broken lines until catch plate 30 releases reset bar 28. When reset bar 28 is freed from catch plate 30, spring 42 contracts and moves lever 31 in the opposite direction of dotted arrows to its normal position. Since reset bar 28 is connected by weldment or other means to lever 31, said reset bar 28 is moved up against target stem 20 causing individual target 14 to be moved to its normal position.

Figure 7:
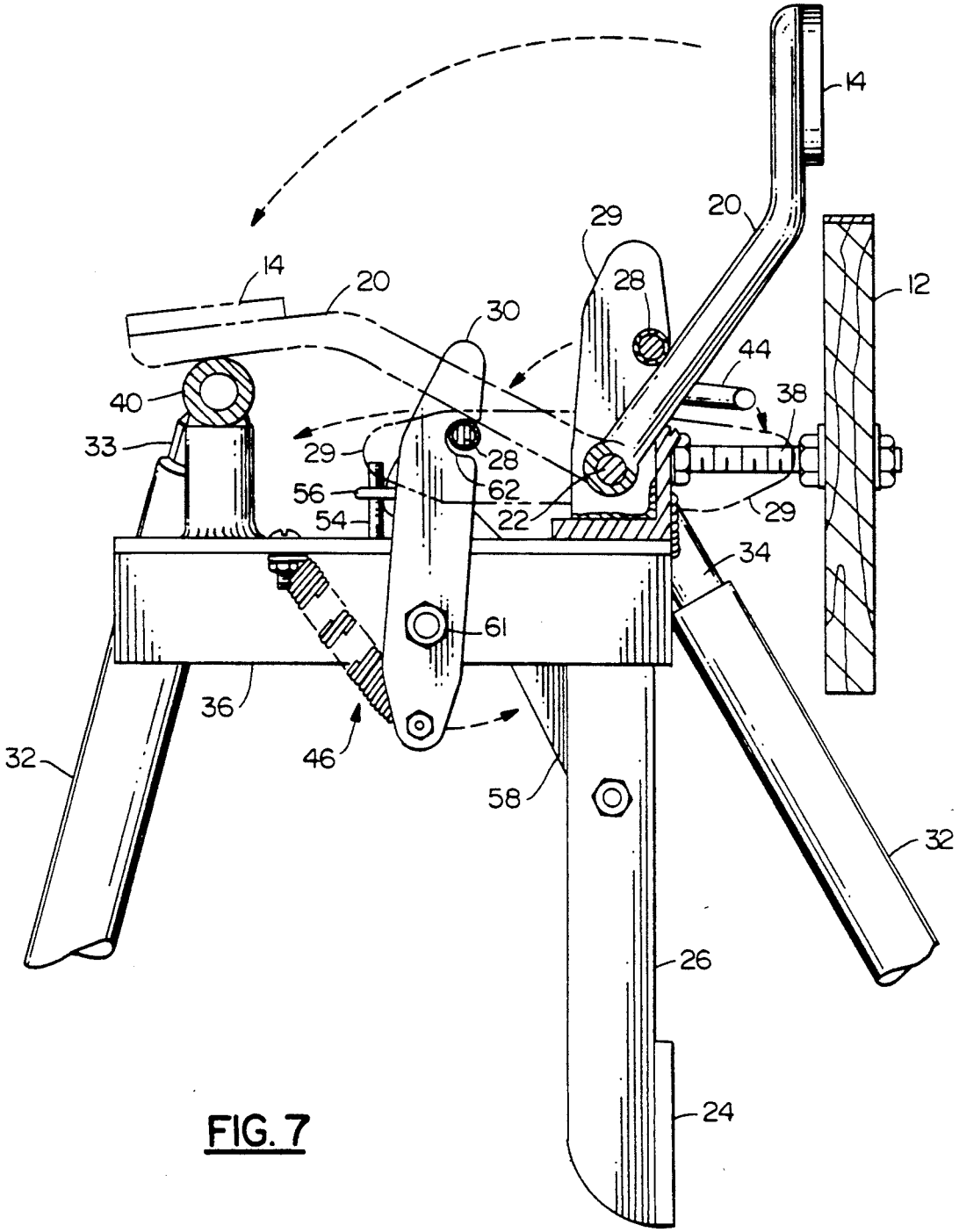
FIG. 7 is a sectional view taken on line 7—7 of FIG. 2.

FIG. 7 is a sectional view taken on line 7—7 of FIG. 2. Upon impact of a bullet or other projectile upon any one of the individual targets 14, target stem 20 is thrown in the direction of the dotted arrow against reset bar 28. Reset bar 28, which is attached to lever 29, and lever 29, which is pivotally mounted on pivot rod 22, move back and down in the direction of the dotted arrow, said reset bar 28 being held in place in notch 62 of catch plate 30, said lever 29 being positioned horizontally as illustrated by broken lines. Spring 46 keeps catch plate 30 in a stationary position over reset bar 28. Individual targets 14 rest on stop rod 40 as shown by broken lines.

When all the individual targets 14 have been thrown back out of their normal, upright position and resting on stop 40, the individual targets 14 are reset, that is, moved back to their original, upright position, from the impact of a bullet or other projectile upon reset plate 24.

The impact of a projectile on reset plate 24 causes reset lever 26 to push engagement rod 54 against catch rod 56. Catch rod 56 causes catch plate 30, which is pivotally mounted on bolt 61, to pivot slightly in the direction of dotted arrows. This action causes reset bar 28 to slip out of notch 62 and to move along with lever 29 to which it is attached to its original position, aided by the downward force of rod 44 upon lever 29 illustrated in broken lines. Spring 46, by a constricting action, causes catch plate 30 to return to its original position once reset bar 28 has been released from notch 62. As reset bar 28 is forced up and forward it contacts target stems 20, moving individual targets 14 to their normal, upright position, and resetting individual targets 14 for continued action.

Figure 8:
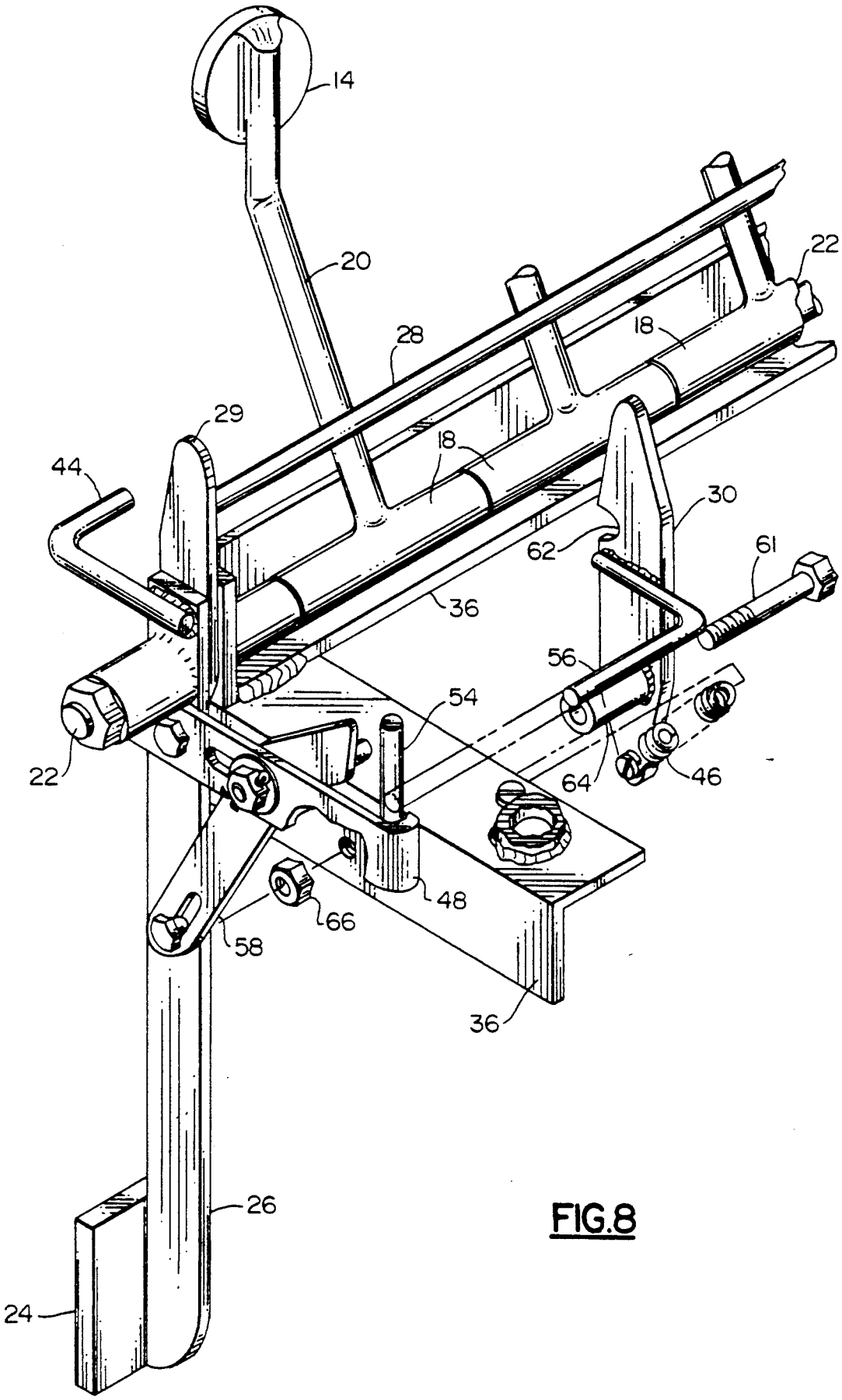
FIG. 8 is an exploded view of the unique reset mechanism.

FIG. 8 is a partially exploded rear side sectional view of the unique reset mechanism. The individual targets 14 are shown in their normal position with reset bar 28 resting against target stems 20. Catch plate 30 is pivotally mounted on bolt 61 which passes through bushing 64 and is fastened to frame 36 by threaded fastener 66. Spring 46 is connected to catch plate 30 and frame 36 by screw or other method. Catch rod 56 is attached to catch plate 30 by weldment or other means and rests lightly against engagement rod 54 in its normal position.

While the invention has been illustrated and described as embodiment in a multiple target apparatus, it is not intended to be limited to the details shown, since various modifications and structural changes may be made without departing in any way from the spirit of the present invention and such will be fully appreciated by those skilled in the art.

I claim:

1. A multiple target apparatus comprising:

a) a plurality of individual targets pivotally mounted upon a common horizontal axis and normally situated in an upright position thereon, said individual targets being adapted to be pivotally moved backwards and down when struck by a bullet or other projectile and pivotally moved up and forward into their normal, upright position simultaneously and automatically by means of a reset mechanism;

b) a horizontally positioned stop rod on which the aforementioned individual targets lay at rest when thrown out of their normal, upright position;

c) a mechanically operated reset mechanism that provides the means for automatically returning the individual targets to their normal, upright position simultaneously, said reset mechanism being activated by the impact of a bullet or other projectile;

d) a rectangular shaped protective shield made of metal, wood, or other suitable material, horizontally positioned on the front of the target apparatus, below the aforementioned individual targets, for the purpose of absorbing, deflecting, or otherwise preventing a bullet or other projectile from damaging the components of the target apparatus;

e) a frame of metal or other suitable material upon which the components of the target apparatus are attached or connected.

f) easily attachable/detachable legs that function as a stand and support the target apparatus.

2. The target apparatus according to claim 1, wherein each individual target is comprised of a rod perpendicularly mounted at one end to a hollow sleeve, said hollow sleeve being pivotally mounted on a common horizontal axis, and a target plate or disk attached to the other end of said rod, said rod being particularly shaped so as to position the target plates slightly above the aforementioned protective shield during their normal, upright position.

3. The target apparatus according to claim 2, wherein each individual target is loosely pivoted upon a common horizontal pivot rod, opposite ends of said pivot rod being supported by a front frame member;

4. The target apparatus according to claim 2, wherein the means for supporting the individual targets in their normal, upright position is a horizontally positioned front frame member.

5. The target apparatus according to claim 2, wherein the means for supporting the individual targets when they have been thrown out of their normal position is a horizontally positioned stop bar mounted at one end to a left frame member and at the other end to a right frame member.

6. The target apparatus according to claim 1, wherein the means for causing the aforementioned individual targets, after being thrown out of their normal upright position, to be automatically returned to their normal, upright position is a mechanically operated reset mechanism.

7. The target apparatus according to claim 6, wherein the reset mechanism comprises:

a) a reset lever with a square or other shaped plate for striking means connected at one end, and a "J" shaped rod connected to the other end, said reset lever being pivotally mounted to the aforementioned horizontal pivot rod;

b) a diagonally positioned bar loosely attached at one end to the midsection of the aforementioned reset lever and resting upon the right frame member at the other end for the purpose of holding said reset lever in its normal position;

c) a horizontally positioned bar loosely connected at one end to the aforementioned reset lever and loosely attached at the center to the aforementioned diagonally positioned bar to allow for a back and forth motion;

d) a horizontally oriented reset rod connected at opposite ends to levers, said levers being pivotally mounted on the aforementioned horizontal pivot rod and held in position by a spring;

e) a notched catch plate which is pivotally mounted upon a screw, bolt, shaft, or similar component connected to the right frame member, said catch plate being vertically held in place by a spring.

8. The target apparatus according to claim 7, wherein the means for engaging the reset mechanism is the aforementioned reset bar being thrown into and held in place by the notch in the aforementioned catch plate, said reset bar being so thrown by the backward movement of the individual targets which have been struck by a bullet or other projectile.

9. The target apparatus according to claim 7, wherein the means for activating the reset mechanism and causing the individual targets, which have been consecutively thrown out of their normal position, to be reset to their normal position is the impact of a bullet or other projectile upon the aforementioned reset plate, said action causing the aforementioned reset bar to be released from the catch plate and moving the individual targets up to their normal position.

10. The target apparatus according to claim 1, wherein the target apparatus is supported by legs made of metal tubing or other suitable material, said legs being attached frictionally to short protrusions on the aforementioned stop rod and front frame member, said protrusions being slightly smaller in their outside diameter than the inside diameter of said legs.

11. The target apparatus according to claim 1, wherein the components of said target apparatus are protected by means of a shield made of wood, metal, or other suitable material mounted to the front frame member so as to shield said components from a bullet or other projectile.

12. The target apparatus according to claim 1, wherein the frame consists of a front frame member and two side frame members upon which the components of the target apparatus are fixed.

* * * * *